United States Patent [19]

Bassist

[11] 4,123,920

[45] Nov. 7, 1978

[54] APPARATUS FOR FEEDING FILLING THREADS TO A WARP KNITTING MACHINE

[76] Inventor: Rudolph G. Bassist, 1003 McGrann Blvd., Lancaster, Pa. 17601

[21] Appl. No.: 829,309

[22] Filed: Aug. 31, 1977

[51] Int. Cl.[2] ..... D04B 23/12

[52] U.S. Cl. ..... 66/84 A; 28/100; 156/439

[58] Field of Search ..... 66/84 A, 125 R; 28/100, 28/101; 156/439

[56] References Cited

U.S. PATENT DOCUMENTS

| | | | |
|---|---|---|---|
| 3,523,432 | 8/1970 | Vajda et al. | 66/84 A |
| 3,620,048 | 11/1971 | Furst | 66/84 A |
| 3,680,332 | 8/1972 | Bassist | 66/84 A |
| 3,681,942 | 8/1972 | Bassist | 66/84 A |
| 3,705,503 | 12/1972 | Skopalik et al. | 66/84 A |
| 3,735,608 | 5/1973 | Billi | 66/125 R |
| 3,771,330 | 11/1973 | Carman | 66/84 A |
| 3,967,469 | 7/1976 | Hepperle | 66/84 A |

*Primary Examiner*—Werner H. Schroeder
*Assistant Examiner*—Andrew M. Falik
*Attorney, Agent, or Firm*—Alan H. Levine

[57] ABSTRACT

First and second spaced apart conveyors, extending toward the knitting instrumentalities of a knitting machine, each carry a plurality of thread clamping means. Guide means bring filling threads from filling thread supplies to the first conveyor where they are clamped. The guide means then moves to the second conveyor to pull filling threads from the supplies and draw them between the conveyors, the filling threads being clamped in the second conveyor. Each thread clamping means carried by each conveyor includes a pair of pivoted clamping members and resilient means urging them to a closed condition. An actuating cam engages the clamping members to open them for receiving a filling thread from the guide means. Funnel-like members are carried by the guide means for directing threads into the clamping means. A single locking bar carried by the guide means locks all filling threads against further withdrawal from the supplies after the threads are clamped in the second conveyor. Each conveyor comprises two spaced apart chains having pins extending between them, each pin serving as the pivot axis of one of the clamping means.

8 Claims, 7 Drawing Figures

APPARATUS FOR FEEDING FILLING THREADS TO A WARP KNITTING MACHINE

This invention relates to wrap knitting machines, and more particularly to such machines capable of knitting fabric incorporating filling threads extending across the width of the fabric.

U.S. Pat. No. 3,680,332 discloses an apparatus for feeding filling threads to a knitting machine, from relatively stationary supplies, so that the filling threads become a permanent part of the knit fabric. In that apparatus, first and second spaced apart conveyors, each of which may be an endless chain, carry a plurality of thread clamping means. A guide means moves between the two conveyors, and pulls filling threads from the relatively stationary supplies. A plurality of first conveyor clamping means are operated simultaneously, as the guide means crosses them, to clamp the filling thread ends. Filling threads are drawn from the first conveyor to the second as the guide means moves, and a plurality of second conveyor clamping means are operated simultaneously as the guide means crosses them, to clamp the filling threads. Thereafter, the filling threads are cut between the second conveyor and the guide means. The conveyors then move the filling threads to the knitting instrumentalities of the knitting machine.

In the apparatus of the patent, each clamping means is designed such that each thread must be partially wrapped around a part of the clamping means, requiring the use of devices for accomplishing the wrapping step. In addition, the guide means carries a plurality of clamps, each clamp being used to lock one of the threads against further withdrawal from its supply after the thread has been clamped in the second conveyor.

It is an object of the present invention to provide thread clamping means of simplified design which eliminates the need for any devices to manipulate the thread preparatory to clamping in the clamping means of both conveyors.

It is another object of the invention to provide a single bar for simultaneously locking all the filling threads against withdrawal from their supplies after the threads are clamped in the second conveyor.

The manner in which these and other objectives are achieved, as well as additional features and advantages of the invention, will be apparent from the following description in which reference is made to the accompanying drawings.

Figure 1:
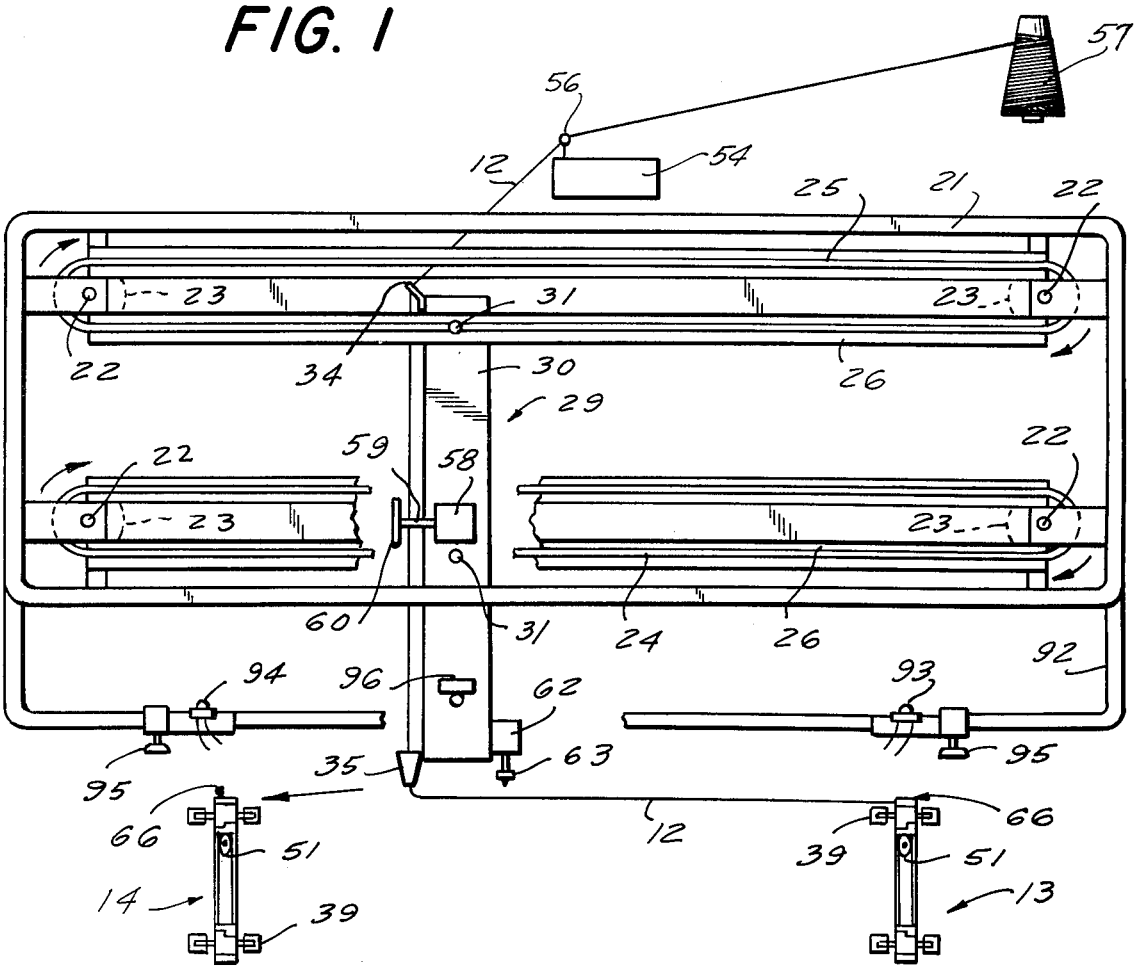
FIG. 1 is a vertical cross-sectional view through the first and second conveyors, looking in the direction of the knitting machine, and showing the filling thread guide means.

FIG. 1 illustrates a first conveyor 13 and a second conveyor 14, each having a top run and a bottom run. The conveyors are spaced apart a distance slightly exceeding the width of the needle bed of the knitting machine (not shown), i.e., the width of the knitted fabric produced by the machine. The conveyors move continuously when the knitting machine is in operation. As viewed in FIG. 1, the top run of each conveyor moves away from the viewer (and toward the knitting machine), and the bottom run of each conveyor moves toward the viewer.

Each conveyor 13 and 14 carries a plurality of thread clamps 66 which will be described in more detail below. The filling threads 12 are introduced into the conveyor clamps by a thread guide means 29 (FIG. 1). Arranged above and generally crosswise with respect to conveyors 13 and 14 are a pair of rectangular stationary frames 21 (only one being visible in FIG. 1). Each frame carries four stub shafts 22, each of which rotatably supports a sprocket wheel 23. An endless conveyor chain 24 is trained about the lower pair of sprocket wheels 23 of each frame 21, and another endless conveyor chain 25 is trained about the upper pair of sprocket wheels 23. Thus, four conveyor chains 24 and 25 are carried by frames 21. A fixed channel-shaped support 26 may be provided to support the top and bottom runs of each chain. One stub shaft 22 of each conveyor chain is connected by a suitable transmission (not shown) to the main drive shaft of the machine so as to move all the chains 24 and 25 in such a way that the lower run of each chain moves from the right toward the left in FIG. 1, i.e., from filling thread conveyor 13 toward filling thread conveyor 14. The purpose of the chains 24 and 25 is to move the thread guide means 29 between conveyors 13 and 14.

The thread guide means is illustrated as a rectangular-block-shaped carriage 30 arranged between frames 21, and having two pins 31 projecting from each side. Each pin 31 is pivotally connected at its end to one of the chains 24 and 25. Thus, at a time when the portion of the chain to which each pin 31 is connected is in the lower run of the chain, as shown in the drawings, carriage 30 is moving from conveyor 13 toward conveyor 14. After passing over the latter, carriage 30 moves upwardly around the sprocket wheels 23 and back toward conveyor 13. After passing over the latter conveyor, carriage 30 moves downwardly around the opposite sprocket wheels 23 and its direction of movement is again reversed.

Along its front upper edge, i.e., its upper edge facing conveyor 14, carriage 30 is furnished with a plurality of thread guide members or eyelets 34, and the same number of funnel-like eyelets 35 is provided along its front lower edge. The number of eyelets 34 or 35 is equal to the number of individual filling threads 12 which are to be applied simultaneously to the conveyors 13 and 14 during each pass of carriage 30 from conveyor 13 to conveyor 14. Theoretically, any number of filling threads can be applied, for example, 72 filling threads may be simultaneously applied to the conveyors.

Arranged above carriage 30 is a long arm 54 swingable about a vertical pivot (not shown). Alternatively, arm 54 may move parallel to the movement of carriage 30. The portion of arm 54 above carriage 30 is furnished with, in this example, 72 eyelets 56. Each eyelet 56 guides a thread 12 from one of 72 thread supplies 57, which may be in the form of the usual wound cones, to one of the eyelets 34 on carriage 30. From eyelet 34, each thread is guided through an eyelet 35. Through a suitable transmission, arm 54 is swung back and forth through an arc having a long enough radius so that its free end carrying eyelets 56 remains close, and substantially parallel, to carriage 30. Arm 54 thereby serves to prevent any slack in threads 12 from becoming entangled in the mechanism which moves carriage 30. If desired, arm 54 may carry conventional type finger tension means, or other device for taking-up slack, to maintain tension in threads 12.

At the beginning of each cycle, carriage 30 is to the right of conveyor 13 in FIG. 1. As carriage 30 moves to the left it inserts the ends of filling threads 12 into clamps 66 of conveyor 13, and the clamps grip these threads. Carriage 30 then moves toward conveyor 14, and during this movement filling threads are pulled from supplies 57 and drawn between conveyors 13 and 14. When carriage 30 reaches conveyor 14, it inserts the threads into clamps 66 of that conveyor, which grip the threads. The threads are then cut to the left of conveyor 14. Carriage 30 returns to the right of conveyor 13, to begin a new cycle, and conveyors 13 and 14 bring the filling threads to the knitting machine.

Figure 3:
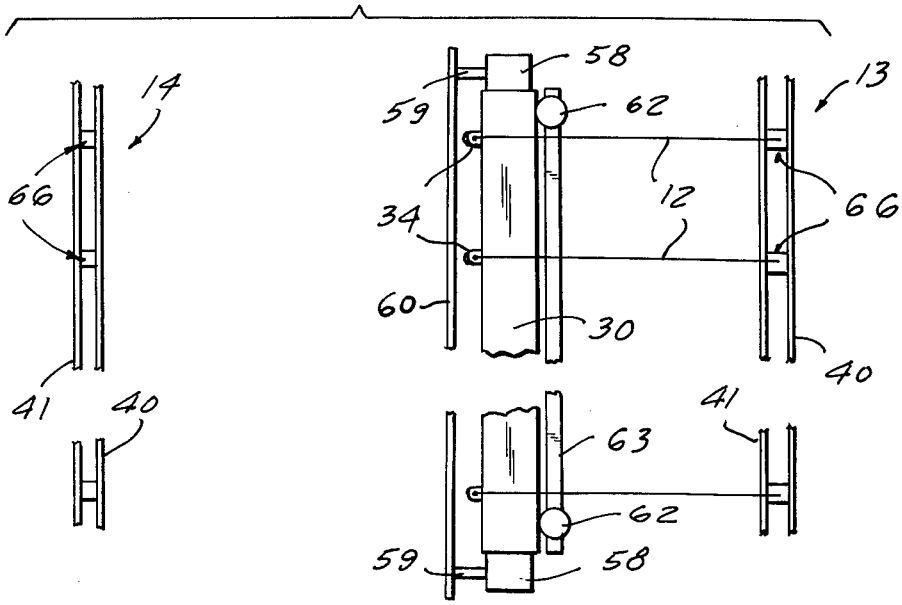
FIG. 3 is a fragmentary top view of the carriage guide means and the first and second conveyors.

Each conveyor 13 and 14 comprises two parallel endless chains 40 and 41 (FIGS. 3 and 7) spaced apart horizontally, each chain being formed of a plurality of articulated links. Each chain 40 and 41 is slidably supported within a stationary channel-shaped support 39, the open sides of the supports facing each other. The links of each chain 40 and 41 are pivoted together on pins 42 (FIGS. 5–7) which extend horizontally between the two chains. Each pin 42 also serves as the pivot pin of one of the thread clamps 66.

Figure 5:
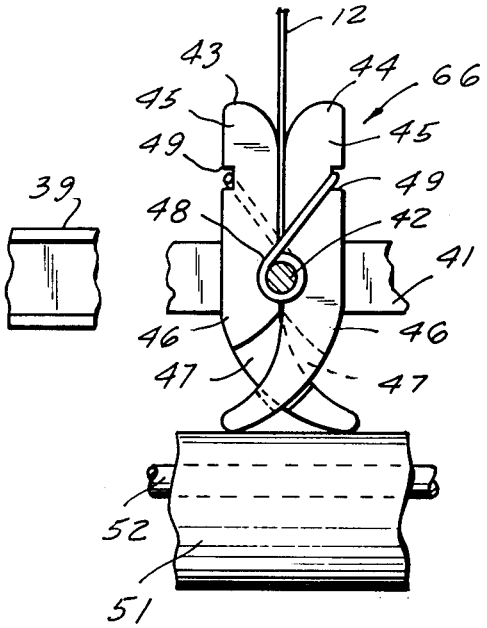
FIG. 5 is a side elevational view, on an enlarged scale, of a thread clamping means in closed condition.
Figure 6:
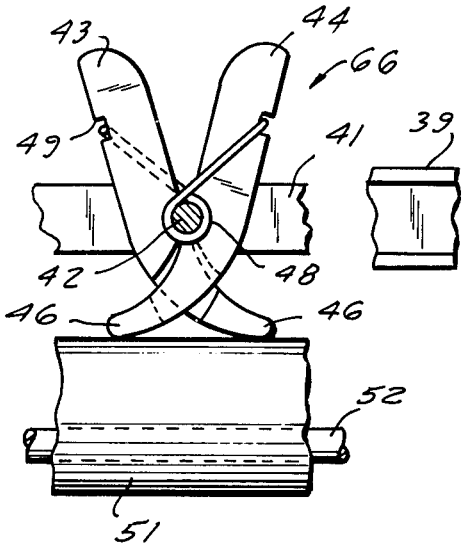
FIG. 6 is a view similar to FIG. 5 showing the thread clamping means in open condition.
Figure 7:
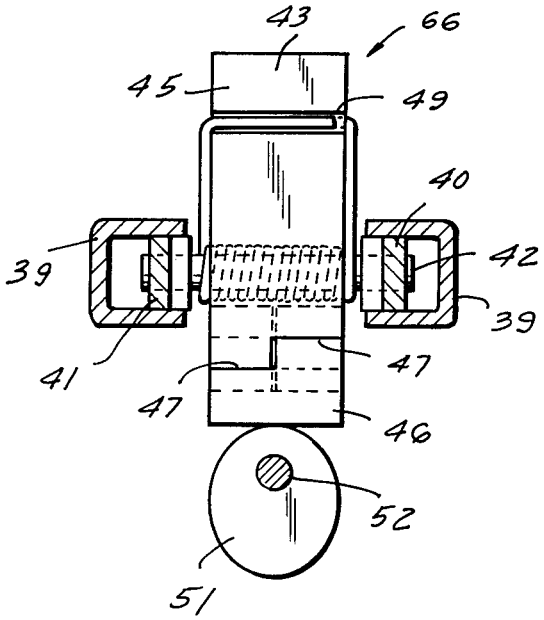
FIG. 7 is a front elevational view of a thread clamping means.

As best seen in FIGS. 5–7, each thread clamp 66 comprises two identical clamping members 43 and 44 pivotally arranged with respect to each other about pin 42. Each clamping member has a thread clamping arm portion 45 above pin 42 and a leg portion 46 below pin 42, the leg portion being curved toward the horizontal. Each leg portion 46 is formed with a rectangular notch 47 extending from one side of the clamping member to its vertical centerline. The two clamping members 43 and 44 are assembled by interengaging their corresponding notched portions with pin 42 between the clamping members. Also between the clamping members is a coil spring 48 surrounding pin 42, the ends of the spring being bent at right angles so that they seat in grooves 49 in the outer faces of clamping members 43 and 44. Spring 48 constantly urges arms 45 of clamping members 43 and 44 toward each other into thread clamping relationship, as shown in FIG. 5.

Figure 4:
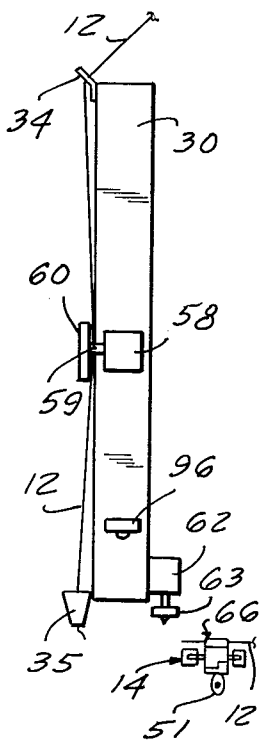
FIG. 4 is a side view of the carriage guide means similar to FIG. 1.
Figure 2:
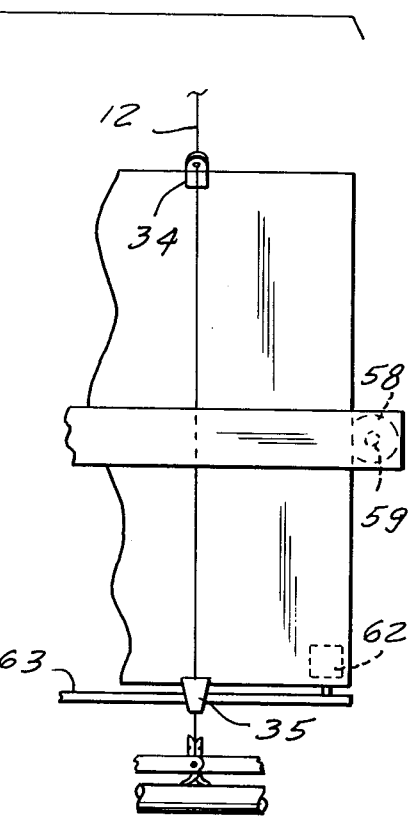
FIG. 2 is a fragmentary front view of the carriage guide means and the first conveyor, looking from the left in FIG. 1.
Figure 2:
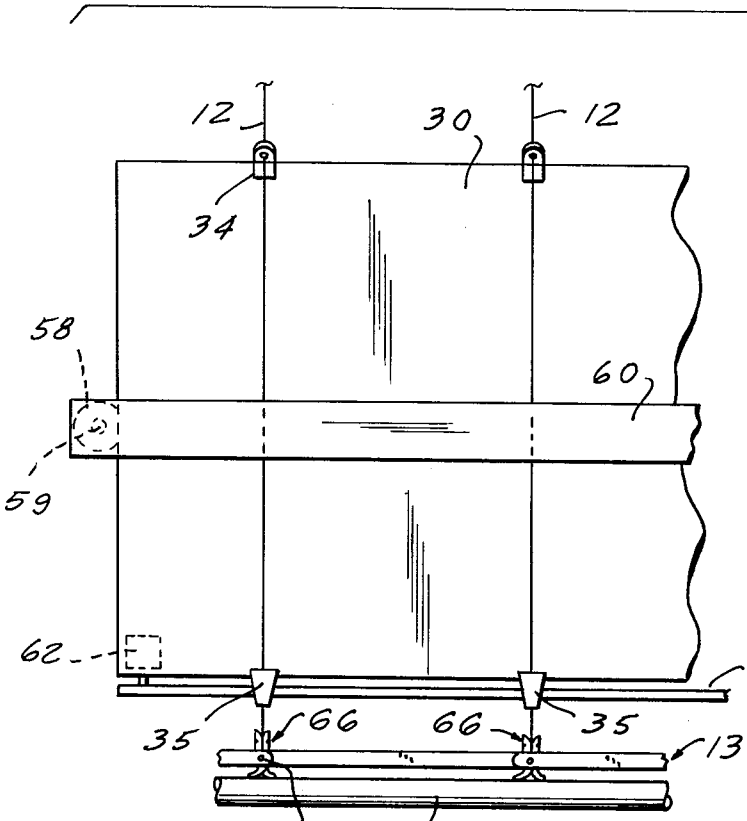

Located beneath the upper run of each conveyor 13 and 14, in the region between frames 21, is a thread clamp actuator, shown in FIGS. 2 and 4 but best seen in FIGS. 5–7. The actuator includes a cam 51 elongated in the direction of movement of its respective conveyor, the length of the cam being sufficient to simultaneously engage, in the present example, 72 clamps 66. Cam 51 is eccentrically mounted for rotation about its longitudinal axis on a shaft 52 having a stationary horizontal axis. When cam 51 is positioned with its larger lobe between shaft 52 and clamps 66, the cam surface engages and spreads leg portions 46 of clamping members 43 and 44, as shown in FIG. 6, thereby spreading arm portions 45, against the force of spring 48, to open the clamp. In this way, all the clamps engaged by the cam are opened simultaneously. When cam 51 rotates 180° about the axis of shaft 52, to bring its smaller lobe between shaft 52 and clamps 66, as shown in FIGS. 5 and 7, spring 48 is permitted to bring arm portions 45 of clamping members 43 and 44 together into thread clamping relationship.

A solenoid 58 (FIGS. 1–4), or other suitable operator, is mounted on each side of carriage 30, the armature 59 of each solenoid extending toward and beyond the front face of the carriage. Mounted on armatures 59, and extending across the full width of carriage 30, and slightly beyond, is a thread locking bar 60. Threads 12 pass from eyelets 34 to eyelets 35 between locking bar 60 and the front face of carriage 30. When solenoids 58 are deenergized locking bar 60 is spaced from the front face of carriage 30 (FIGS. 1 and 3) and threads 12 are free to move from eyelet 34 to eyelet 35. When solenoids 58 are energized, locking bar 60 is pulled against the front face of carriage 30 (FIG. 4) thereby locking threads 12 against movement between eyelets 34 and 35.

Mounted on the lower part of the rear face of carriage 30 are two additional solenoids 62 (FIGS. 1-4), the depending armatures of which carry a cutting bar 63 extending for the full width of carriage 30. The cutting bar may include a knife edge or hot wire or any other device capable of cutting threads 12. Cutting bar 63 is maintained above the plane containing threads (see FIG. 1) as carriage 30 moves from conveyor 13 to conveyor 14. Immediately after carriage 30 passes conveyor 14 (FIG. 4) and threads 12 are clamped in the clamps 66 of that conveyor, solenoids 62 are energized momentarily to cause cutting bar 63 to descend and sever all the threads 12.

Operation of cam 51 and solenoids 58 and 62 may be controlled by movement of carriage 30. Fixed to one of the frames 21 is a switch support bar 92 (FIG. 1) carrying electrical switches 93 and 94. Preferably, there are two independently operable switches at approximately the location of switch 93, and three independently operable switches at approximately the location of switch 94. Each of the switches may be adjustably positioned along the length of bar 92, and fixed in any position of adjustment by means of set screw 95. A switch actuator 96 is carried by carriage 30, and switches 93 and 94 are always in the path of movement of actuator 96 regardless of their positions of adjustment along bar 92.

When carriage 30 is to the right of conveyor 13, at the beginning of a cycle, cam 51 associated with that conveyor is in the position shown in FIG. 6 so that clamps 66 carried by conveyor 13 are open. In addition, solenoids 58 are energized, so that locking bar 60 locks threads 12 against the front face of carriage 30, and solenoids 62 are deenergized so that cutting bar 63 is in its upper position shown in FIG. 1. As carriage 30 moves over conveyor 13, the ends of each thread 12 extending from funnel-like eyelet 35 moves between the open arms 45 of one of clamps 66. To insure proper placement of each thread end, the lower tip of each eyelet 35 may move between the open arms of its respective clamp, although the lower tips of eyelets 35 may be slightly above the clamps as shown in the drawings.

When switch actuator 96 actuates one of the switches 93, cam 51 associated with conveyor 13 quickly rotates 180°, to the position shown in FIGS. 5 and 7, causing each clamp 66 to close and clamp the end of its respective thread 12. Rotation of cam 51 may be effected by a solenoid (not shown). Actuation of another switch 93 deenergizes solenoids 58 causing bar 60 to move away from carriage 30 and release threads 12. As carriage 30 passes over conveyor 14, threads 12 pass into the open clamps 66 of that conveyor, the clamps having been opened by movement of cam 51 associated with conveyor 14 to the position shown in FIG. 6. When switch actuator 96 actuates the three switches 94, three operations occur at about the same time. Cam 51 associated with conveyor 14 is rotated 180°, such as by means of a solenoid (not shown), to the position of FIGS. 5 and 7, to close clamps 66 of that conveyor; solenoids 58 are energized to bring locking bar 60 against the front face of carriage 30 (FIG. 4) and thereby lock threads 12 against further withdrawal from supplies 57; and solenoids 62 are energized momentarily to move cutting bar 63 downwardly (FIG. 4) and thereby sever all of the threads 12. Solenoids 58 remain energized during the return movement of carriage 30 from conveyor 14 to conveyor 13, and until one of the switches 93 is again situated.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. In an apparatus for feeding filling threads to a wrap knitting machine comprising:

first and second spaced apart conveyor means extending toward the knitting instrumentalities of the machine, a plurality of thread clamping means carried by and movable with each of said conveyor means, a plurality of filling thread supplies, guide means movable, independently of said thread supplies, crosswise over said first conveyor means for simultaneously introducing the ends of a plurality of filling threads from said supplies into said clamping means of said first conveyor means, said guide means moving from said first conveyor means to said second conveyor means to draw filling threads, pulled from said supplies, between said conveyors, and said guide means moving crosswise over said second conveyor means to introduce the filling threads into said clamping means of said second conveyor means.

the improvement characterized by each of said thread clamping means comprising:

a pair of clamping members pivoted to each other about an axis, between the ends of both members, fixed with respect to its respective conveyor, each clamping member being pivotable about the pivot axis and having an arm portion at one side of the pivot axis and a foot portion at the other side of said pivot axis, resilient means constantly urging said arm portions toward each other into thread-clamping relationship, and actuating means for simultaneously operating a plurality of said clamping means carried by each conveyor, said actuating means engaging both foot portions of each clamping means to pivot each of said arm portions away from the other against the force of said resilient means and open said clamping means, said actuating means thereafter permitting said resilient means to close said clamping means.

2. Apparatus as defined in claim 1 including a separate actuating means associated with each of said conveyors.

3. Apparatus as defined in claim 1 including a plurality of funnel-like members carried by said guide means, each funnel-like member accommodating one thread and directing that thread into one of said clamping means.

4. Apparatus as defined in claim 1 wherein said arm portions of each clamping means extend vertically when said clamping means is closed, and said foot portions are curved toward the horizontal.

5. Apparatus as defined in claim 1 including a single locking bar carried by said guide means for simultaneously locking the filling threads against further withdrawal from said supplies after the threads have been clamped in said clamping means of said second conveyor means.

6. Apparatus as defined in claim 1 wherein each of said conveyor means comprises two horizontally spaced apart chains, and a plurality of pins extending between said chains, said clamping members of each clamping means being supported on one of said pins and said pin defining the pivot axis between said clamping members.

7. Apparatus as defined in claim 6 including support means slidably supporting each of said chains, each support means including a channel-shaped member positioned with its open side facing the other channel shaped member.

8. In an apparatus for feeding filling threads to a warp knitting machine comprising:

first and second spaced apart conveyor means extending toward the knitting instrumentalities of the machine, a plurality of thread clamping means carried by and movable with each of said conveyor means, a plurality of filling thread supplies, guide means movable independently of said thread supplies for bringing a plurality of filling threads from said supplies to said first conveyor means where they are simultaneously clamped by said clamping means of said first conveyor means, said guide means moving from said first conveyor means to said second conveyor means to draw filling threads, pulled from said supplies, between said conveyors, and said guide means bringing the filling threads to said second conveyor means where they are simultaneously clamped by said clamping means of said second conveyor means, the improvement characterized by each of said thread clamping means comprising:

a pair of clamping members pivoted to each other at a point between the ends of both members, each clamping member having an arm portion at one side of the pivot axis and a foot portion at the other side of said pivot axis, resilient means constantly urging said arm portions toward each other into thread-clamping relationship, and actuating means for simultaneously operating a plurality of said clamping means carried by each conveyor, said actuating means engaging said foot portions of each clamping means to spread said arm portions against the force of said resilient means and open said clamping means, said actuating means thereafter permitting said resilient means to close said clamping means, and said actuating means comprising a cam elongated in the direction of movement of said conveyor means, said cam being rotatable about an axis parallel to the direction of movement of said conveyor means and eccentric with respect to its axis of rotation.

* * * * *